US005792027A

United States Patent [19]

Gvoich

[11] Patent Number: 5,792,027

[45] Date of Patent: Aug. 11, 1998

[54] AEROBIC STRIDING EXERCISER

[75] Inventor: Ned Gvoich, Scottsdale, Ariz.

[73] Assignee: Kordun, Ltd., Scottsdale, Ariz.

[21] Appl. No.: 780,821

[22] Filed: Jan. 9, 1997

[51] Int. Cl.[6] ..... A63B 2/00

[52] U.S. Cl. ..... 482/51; 482/52

[58] Field of Search ..... 482/51, 52, 70, 482/71, 79, 80, 114

[56] References Cited

U.S. PATENT DOCUMENTS

| | | | |
|---|---|---|---|
| 4,850,585 | 7/1989 | Dalebout | 272/70 |
| 4,940,233 | 7/1990 | Bull et al. | 272/130 |
| 5,000,443 | 3/1991 | Dalebout et al. | 272/70 |
| 5,336,141 | 8/1994 | Vittone | 482/51 |
| 5,496,235 | 3/1996 | Stevens | 482/51 |
| 5,584,780 | 12/1996 | Lin | 482/51 |
| 5,584,781 | 12/1996 | Chen | 482/52 X |
| 5,603,675 | 2/1997 | Wu | 482/52 |
| 5,605,521 | 2/1997 | Hsieh | 482/51 |
| 5,616,103 | 4/1997 | Lee | 482/51 |

FOREIGN PATENT DOCUMENTS

| | | | |
|---|---|---|---|
| 2025280 | 3/1992 | Canada | 482/52 |

*Primary Examiner*—Richard J. Apley
*Assistant Examiner*—Denise Pothier
*Attorney, Agent, or Firm*—John D. Titus

[57] ABSTRACT

A striding exerciser comprises a pair of pedals or platforms, each suspended from a frame by a linkage such that the pedals move back and forth through an arc to simulate a natural walking or striding motion. Preferably the linkage is a triangulated four bar linkage, which permits the pedals to move freely back and forth while providing substantial lateral rigidity to resist side-to-side motion. In one embodiment of the invention, a pair of handles are pivotally attached to the frame behind and to the side of a user standing on the platforms. Each of the handles is connected to the corresponding four bar linkage, such that motion of a platform is translated into motion of the corresponding handle. In another embodiment the triangulated four bar linkages share a common pivot shaft and are acted on by a common resistance mechanism such that equal resistance is applied to both platforms.

11 Claims, 5 Drawing Sheets

AEROBIC STRIDING EXERCISER

BACKGROUND OF THE INVENTION

The present invention relates to exercise in general and to manually operated exercise equipment in particularly to apparatus for performing walking or striding exercises, comprising a frame supporting a pair.

Striding exercise equipment generally comprises a pair of oscillating pedals or other foot supports constrained to move in an arc simulating the natural movement of the user's feet during walking. U.S. Pat. No. 4,850,585 to Dalebout discloses a striding exerciser comprising a frame supporting a pair of pedals each supported by a single arm pivotally attached to the frame. The pivot points of the pedal arms are intended to be located approximately opposite the hip joint of the user such that the center of rotation of each of the pedals is located at the user's hip. Resistance is applied independently to each of the two pedal arms using frictional resistance devices attached at each pivot point. Accordingly, unless the resistance devices are carefully adjusted, it is possible for the resistance to be applied unequally to the two pedal arms.

U.S. Pat. No. 5,496,235 to Stevens describes the prior art as including walking exercisers comprising a pair of platforms each supported by a simple parallelogram linkage, such that the platforms move through an arc while remaining horizontal. Stevens also teaches a walking exerciser comprising a pair of platforms each supported by a trapezoidal four bar linkage, such that the platforms move through an arc while simultaneously rotating. Resistance to motion of the platforms is also applied independently to each platform using frictional resistance devices attached at the upper pivots.

What the prior art lacks is a striding exerciser in which the resistance is applied uniformly to resist motion of the left foot and the right foot equally. Additionally, what the prior art lacks is a striding exerciser having a triangulated linkage to provide substantial lateral stiffness to the swinging platforms.

SUMMARY OF THE INVENTION

According to the present invention a striding exerciser comprises a pair of pedals or platforms, each suspended from a frame by a four bar linkage such that the pedals move back and forth through an arc to simulate a natural walking or striding motion.

In one embodiment of the invention, a pair of handles are pivotally attached to the frame behind and to the side of a user standing on the platforms such that the axis of rotation of the handles does not coincide with the axis of rotation of the pedal. Each of the handles is connected to the corresponding four bar linkage, such that motion of a platform is translated into motion of the corresponding handle. The handles may share a common axis with two of the pivot points of the four bar linkages, or may have independent pivot points. In the first case, the handles may be driven by a simple locking pin that fixes the angular orientation between the handle and the link about the common axis. In the latter case, the handle may be driven by a crank and connecting rod, or other suitable linkage, with the added benefit of an adjustable linkage ratio between the platform linkage and the handle.

In another embodiment of the invention, both of four bar linkages comprise triangulated linkages that share one common pivot shaft. The triangulated linkage is inherently more stable than a simple parallelogram or trapezoidal linkage, in which all of the pivot points lie in a common plane.

In yet another embodiment, the common pivot is positioned immediately in front of the user and a friction resistance mechanism is shared by the common pivots. The shared friction resistance mechanism inherently applies equal resistance to both pivots, thereby leading to greater ease of use.

BRIEF DESCRIPTION OF THE DRAWING

The present invention will be better understood from a reading of the description, taken in conjunction with the accompanying drawing in which like numerals denote like elements, and in which.

DETAILED DESCRIPTION

Figure 1:
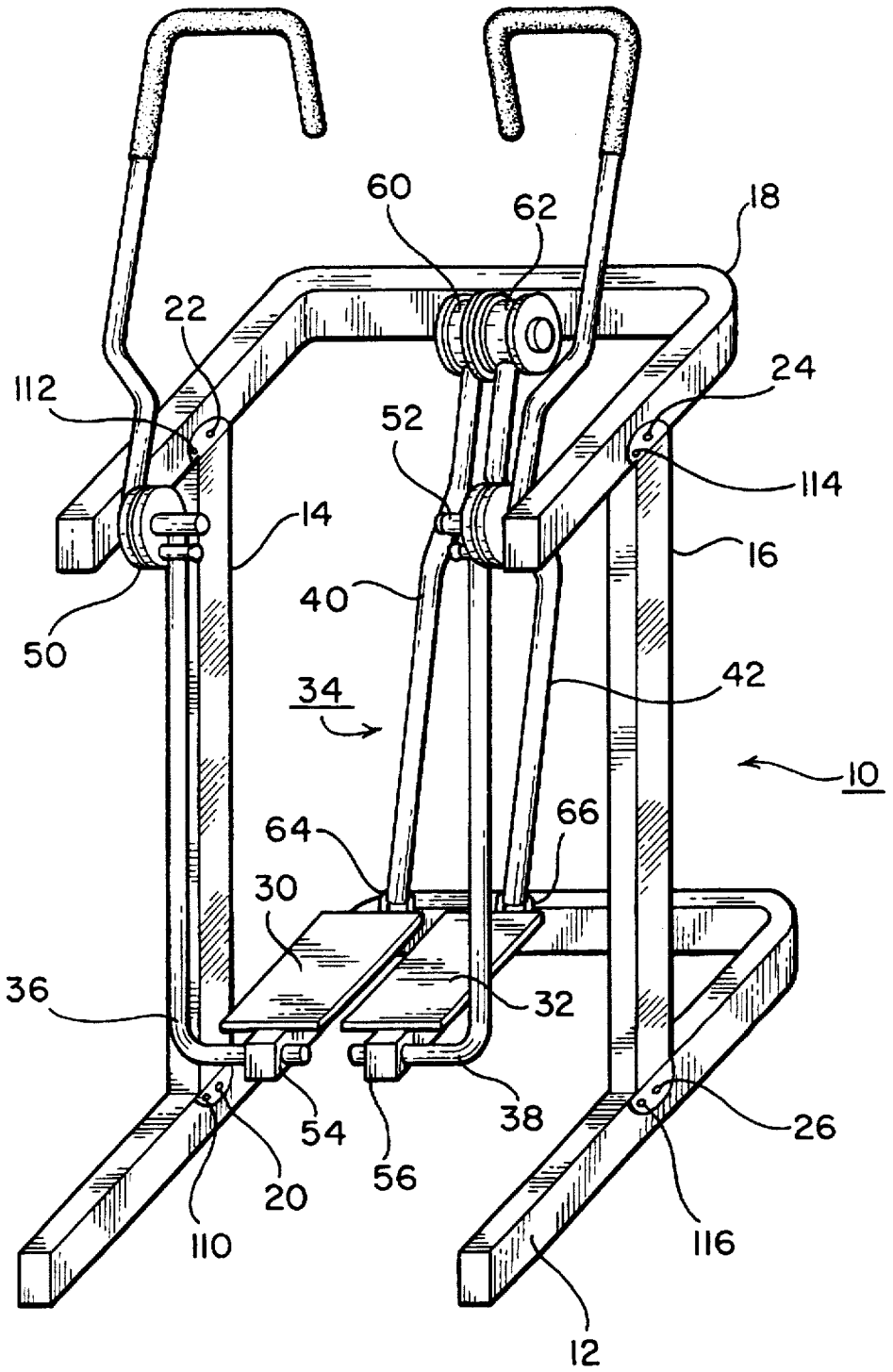
FIG. 1 is a perspective view of an exercise apparatus incorporating features of the present invention.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances. For example although the common pivot that supports the swinging platforms is described as being positioned forward of a user and the individual pivots described as being beside and to the rear of a user if reversed, the common pivot would be positioned behind the user and the individual pivots beside and in front of the user.

Referring to FIG. 1, an exercise apparatus incorporating features of the present invention comprises a frame, generally indicated at 10, comprising a base 12, a first upright 14, a second upright 16 and an upper support 18. The frame serves to support the remainder of the apparatus above a solid support surface, such as a floor. The frame 10 is constructed of extruded tubing of rectangular cross-section. However, other frame constructions are possible. Any frame that is stable and sturdy would be acceptable. In the embodiment of FIG. 1, the upright 14 and upright 16 are pivotally attached to base 12 and upper support 18 by frame pivots 20, 22, 24, and 26 which permit frame 10 to be folded flat for storage. To prevent frame 10 from folding inadvertently, frame pivots 20, 22, 24 and 26 may be locked in position by means of a lock pins 100, 112, 114, and 116 engaging corresponding recesses in base 12 and upper support 18 or by other conventional means well known in the art.

A first platform 30 and a second platform 32 which are suspended from upper support 18 by means of a triangulated four bar linkage indicated generally at 34. The linkage 34 comprises a first rear link 36, a second rear link 38, a first forward link 40 and a second forward link 42. The upper end of first rear link 36 is pivotally attached to upper support 18 by rotating joint 50. The lower end of first rear link 36 is pivotally attached to platform 30 by rear platform pivot 54. In a similar manner, second rear link 38 is pivotally attached to upper support 18 and platform 32 by rotating joint 52 and platform pivot 56, respectively. Likewise, the forward ends of platforms 30 and 32 are suspended from forward rotating joints 60 and 62 by links 40 and 42 through platform pivots 64 and 66. As can be seen more clearly in FIG. 2, link 40 causes the forward edge of platform 30 to move through an arc about rotating joint 60 and link 36 causes the rear end of platform 30 to move through an arc about rotating joint 50, in a manner common to four bar linkage arrangements. By adjusting the distance between rotating joint 60 and rotating joint 50 relative to the distance between platform pivots 54 and 64, platform 30 can be made to rotate about an arbitrary axis of rotation, or if the pivot distances are made equal, the four bar linkage becomes a parallelogram linkage and platform 30 remains horizontal as it moves through its arc.

Figure 3:
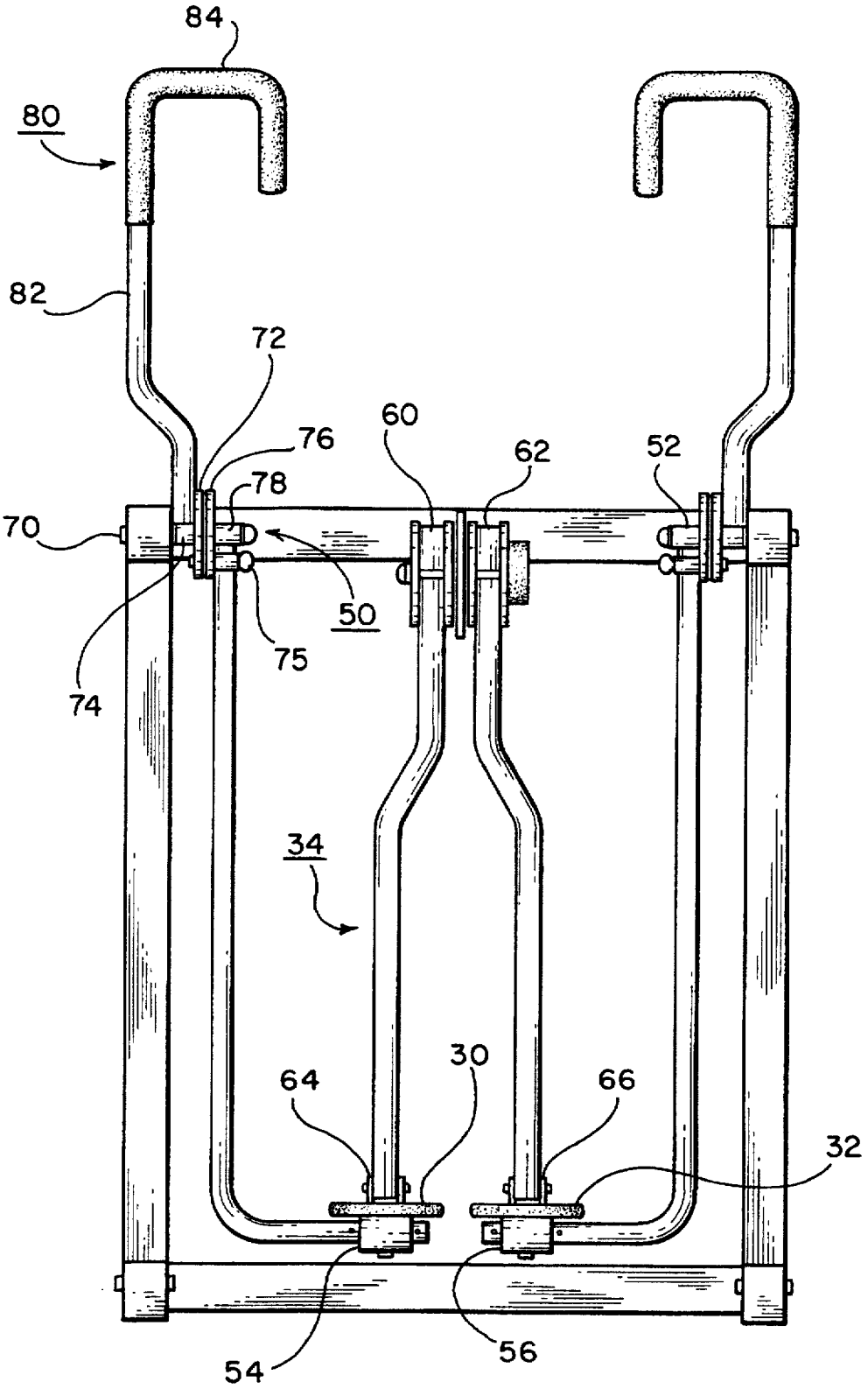
FIG. 3 is a rear plan view of the apparatus of FIG. 1.

With reference to FIG. 3, the linkage 34 comprises a triangulated four bar linkage, in that rotating joint 60 is displaced laterally from rotating joint 50 and rotating joint 62 is displaced laterally from rotating joint 52. As used herein, when reference is made to the lateral displacement of rotating joint 60 with respect to rotating joint 50, or lateral displacement of rotating joint 62 with respect to rotating joint 60, what is meant is that rotating joint 60 or 62 does not lie in the plane passing through rotating joint 50 or 52 respectively normal to the axis of rotation of rotating joint 50 or 52. Thus, as shown in FIG. 3, which is a plan view of the embodiment of FIG. 1 in a plane normal to the motion of the swinging platform, if a line of action is passed through the center of rotating joint 50, to the center of platform pivots 54 and 64 and through the center of rotating joint 60, a triangle is formed in the plane normal to the motion of the platform. Any attempt to displace the platform laterally, such as if the user temporarily loses his/her balance, is inherently resisted by the triangular orientation of the pivot points as a tension or compression force along the links. Accordingly, little or no transverse bending moment is exerted on the pivots.

This is to be contrasted with simple parallelogram or trapezoidal linkages of the prior art (such as disclosed in U.S. Pat. No. 5,496,235) in which the centers of action of both upper pivots for a given swinging platform lie substantially in a common plane normal to the axis of rotation. With such a planar linkage, any lateral displacement of the swinging pedals exerts a transverse moment along the links that can only be resisted at the frame pivots. Thus, not only must the frame pivots themselves be of heavy construction to resist this transverse moment, but also the links that comprise the linkage must be made more heavily, to withstand the bending moment. Because the triangulated linkage is inherently more laterally stable, the links 36, 38, 40 and 42 and the rotating joints themselves 50, 52, 60 and 62 may be of substantially lighter construction than was heretofore possible.

With reference to FIG. 1 and FIG. 3, rotating joint assembly 50 comprises an axle 70 oriented horizontally and attached to upper support 18. A first flange 72 having a journal 74 is disposed over axle 70. Attached to flange 72 is a first handle 80 comprising an arm 82 and a hand grip 84. Arm 82 is preferably a cylindrical tubular member welded to flange 72. Handgrip 84 is connected to arm 82 in a conventional manner to provide a comfortable and non-slip surface for the user's hands. Handgrip 84 is preferably formed of hard foam, but may also be made of plastic or other suitable materials. A second flange 76 having a second journal 78 is disposed over axle 70 adjacent flange 72. Link 36 is supported by flange 76 and journal 78 to pivot about axle 70. Similarly, arm 82 is supported by flange 72 and journal 74 to pivot independently about axle 70. A plurality of holes or recesses 73 (most clearly shown in FIG. 2) facing flange 76 are disposed in flange 72 at an equal radius from axle 70. A lock pin 75 of conventional construction selectively engages one of the lock pin holes 73, thereby fixing handle 80 to move synchronously with platform 30 at a selectable angular orientation. Hub assembly 52 is of similar construction. Although, the embodiment of FIGS. 1, 2 and 3 discloses a locking pin arrangement that keys the handgrip 84 to link 36 about a common axis of rotation, a handle pivotable about an axis of rotation not in common with link 36, or a handle driven by means of a linkage, such as a crank arm attached to link 36, are considered within the scope of the present invention.

Figure 2:
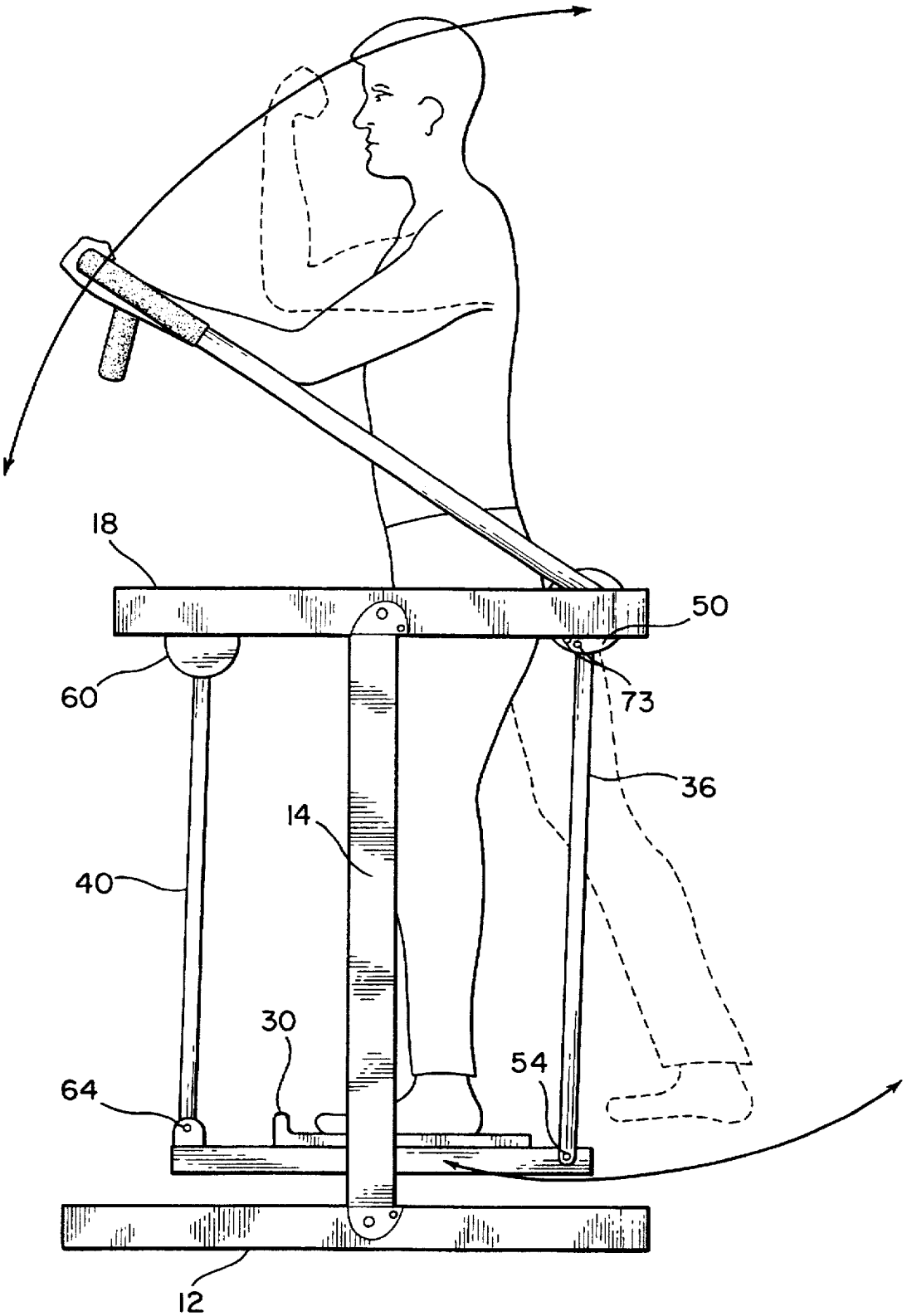
FIG. 2 is a side plan view of the apparatus of FIG. 1.

As shown in FIG. 2, the axis of rotation of handle 80 is located behind the hips of a user standing on platform 30 and 32. By locating the axis of rotation of handle 80 behind the user, the radius of the arc through which the handle 80 moves is large enough to be conducive to performing a variety of bicep, shoulder and other upper body exercises.

Figure 5:
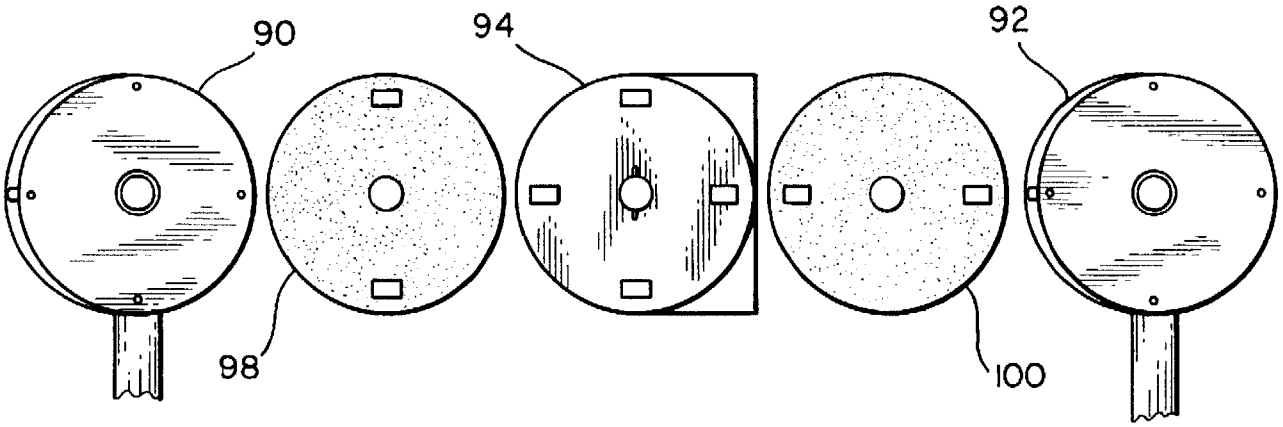
FIG. 5 is an exploded view of the resistance mechanism of FIG. 4.
Figure 4:
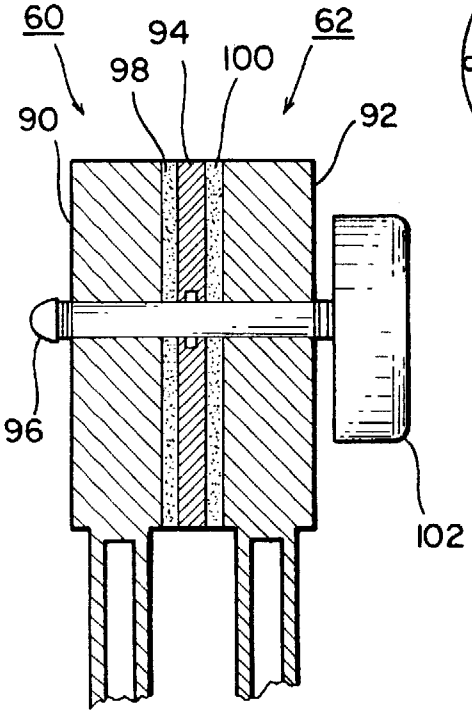
FIG. 4 is a cross sectional view of a resistance mechanism incorporating features of the present invention.

With reference to FIG. 4, rotating joint 60 and rotating joint 62 comprise hubs 90 and 92, respectively, which are supported by a common flange 94 depending from upper support 18 substantially in front of the hips of a user standing erect on platforms 30 and 32. Hubs 90 and 92 are supported by shaft 96 which passes through flange 94. Shaft 96 is keyed or otherwise secured to flange 94 to prevent its rotation. Disposed between hub 90 and flange 94 is friction pad 98. Similarly disposed between hub 92 and flange 94 is second friction pad 100. Friction pads 98 and 100 are preferably composed of a commercially available non-asbestos brake-lining material, leather, or other suitable material to provide the desirable friction characteristics without undue wear. A knob 102 is threaded to one end of shaft 96. As knob 102 is tightened on shaft 96 the assembly comprising hubs 90 and 92, friction pads 98, 100, and flange 94 are drawn together increasing the normal force against the friction pads 98, 100, to provide a variable frictional resistance that is applied equally to resist motion of hubs 90 and 92 (and therefore motion of platforms 30 and 32). With reference to FIG. 5 to provide additional control over the frictional characteristics of the friction pads 98, 100, flange 94 may be provided with one or more tabs which engage corresponding notches or holes in friction pads 98 and 100 to key the friction pads to the flange such that only the surfaces of hubs 90 and 92 move against the friction pads 98, 100.

Figure 8:
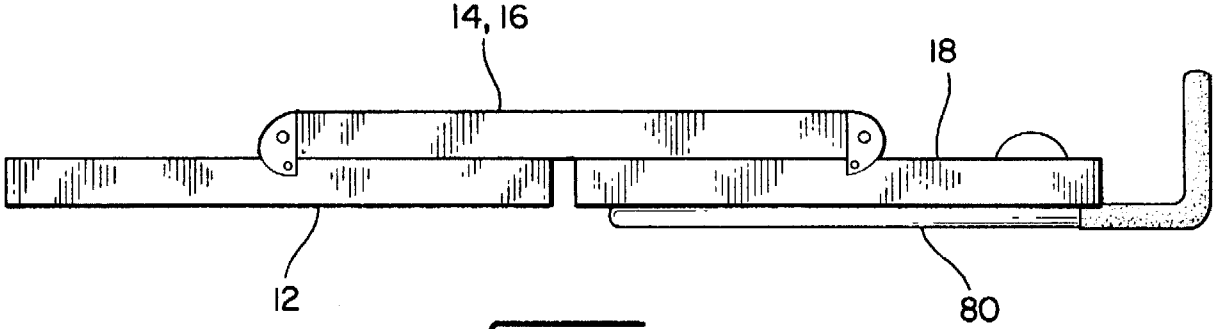
FIG. 8 is a side plan view of a resistance mechanism incorporating features of the present invention.
Figure 7:
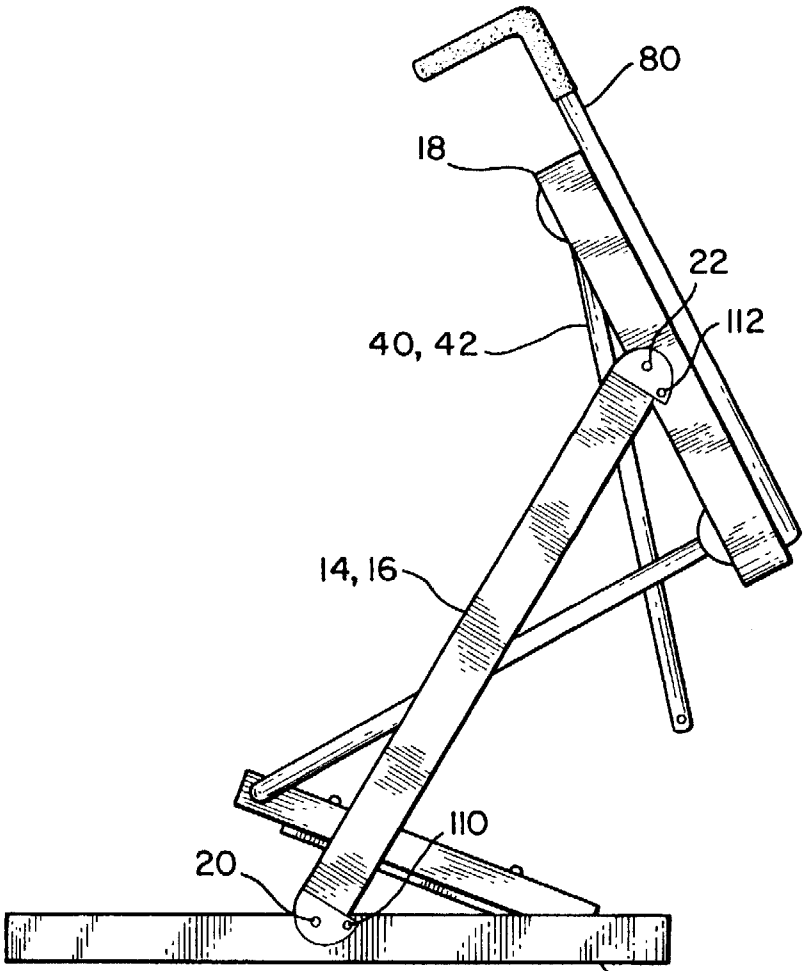
FIG. 7 is a side plan view of a resistance mechanism incorporating features of the present invention.
Figure 6:
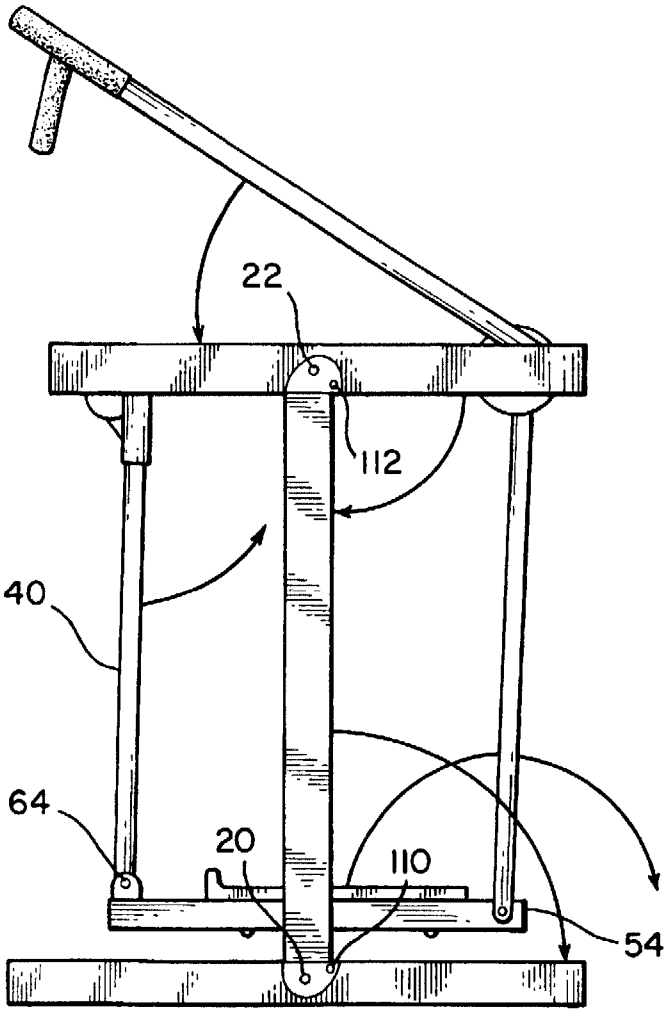
FIG. 6 is a side plan view of a resistance mechanism incorporating features of the present invention.

With reference to FIG. 1, FIG. 6, FIG. 7 and FIG. 8, upper support 18 pivots about pivot point 22 and 24 and base 12 pivots about frame pivot 20 and 26 to permit frame 10 to fold flat for storage. To accomplish this, lock-pins 110 and 112 and corresponding lock-pins 114 and 116 are released. Front platform pivots 64 and 66 are released and platforms 30 and 32 are rotated 180° about rear platform pivot 54. With reference specifically to FIG. 7, front links 40 and 42 are rotated about rotating joints 60 and 62 toward upper support 18. Lock-pins 75 and 93 are released to permit handle 80 and handle 81 to fold down towards upper support 18. Uprights 14 and 16 are then rotated toward the rear of base 12 about frame pivots 20 and 26 as upper support 18 is rotated about frame pivots 22 and 24 approximately 180° (as shown in FIG. 7) until base 12 and upper support 18 lie approximately in the same plane with the rear edge of frame 12 proximal the rear edge of upper support 18 as shown in FIG. 8.

Although certain preferred embodiments and methods have been disclosed herein, it will be apparent from the foregoing disclosure to those skilled in the art that variations and modifications of such embodiments and methods may be made without departing from the true spirit and scope of the invention. For example, although the triangulated four bar linkage shown in the embodiment of FIG. 1 includes front rotating joints 60 and 62 that are displaced toward each other, a triangulated linkage in which rotating joints 60 and 62 are displaced laterally away from each other would be within the scope of the present invention. Accordingly, it is intended that the invention shall be limited only to the extent required by the appended claims and the rules and principles of applicable law.

What is claimed is:

1. An exercise apparatus for performing a striding exercise, comprising:

a frame;

a first platform having a first end and a second end spaced apart from said first end;

a second platform having a third end and a fourth end spaced apart from said third end, said first platform and said second platform being capable of supporting a user standing upon said first and second platforms;

a first linkage and a second linkage for suspending said first and second platforms respectively from said frame, said first linkage comprising:

a first elongated link having a lower end pivotally attached to said first end and having an upper end pivotally attached to said frame at a first rotating joint;

a second elongated link having a lower end pivotally attached to said second end and having an upper end pivotally attached to said frame at a second rotating joint, said second rotating joint being displaced laterally from said first rotating joint:

said second linkage comprising:

a third elongated link having a lower end pivotally attached to said third end and having an upper end pivotally attached to said frame at a third rotating joint;

a fourth elongated link having a lower end pivotally attached to said fourth end and having an upper end pivotally attached to said frame at a fourth rotating joint, said fourth rotating joint being displaced laterally from said third rotating joint;

whereby said first and second elongated links form a first triangulated four bar linkage for supporting said first platform and said third and fourth links form a second triangulated four bar linkage for supporting said second platform.

2. The exercise apparatus of claim 1, further comprising:

a first and second handle pivotally mounted on opposite sides of said frame proximal said first and third rotating joint, respectively;

means responsive to motion of said first platform for imparting motion to said first handle; and means responsive to motion of said second platform for imparting motion to said second handle.

3. The exercise apparatus of claim 2, wherein:

said means responsive to motion of said first platform comprises:

a first flange fixed to said first rotating joint;

a second flange fixed to an end of said handle; and means for selectively keying said first flange to said second flange, whereby said first handle is constrained to rotate with said first platform about said first rotating joint.

4. The exercise apparatus of claim 3, wherein:

said means responsive to motion of said second platform comprises:

a third flange fixed to said first rotating joint;

a fourth flange fixed to an end of said handle; and means for selectively keying said third flange to said fourth flange, whereby said second handle is constrained to rotate with said second platform about said third rotating joint.

5. The exercise apparatus of claim 1, wherein:

said second rotating joint and said fourth rotating joint comprise a unitary assembly comprising:

a single shaft;

a first hub attached to said second link and journaled about said single shaft;

a second hub attached to said fourth link and journaled about said single shaft adjacent said first hub.

6. The exercise apparatus of claim 5, further comprising:

first and second frictional resistance means operatively engaging said first and second hub; and means for simultaneously compressing said first and second frictional resistance means against said first and second hub.

7. The exercise apparatus of claim 1, wherein:

said frame further comprises a base, a first and second upright and an upper support; and wherein said base comprises a substantially horizontal "U" shaped member adapted for resting on a solid surface, said upper support comprises a substantially horizontal "U" shaped member capable of supporting a plurality of rotating journals for supporting said first and second linkages.

8. The exercise apparatus of claim 7, further comprising:

pivots operatively disposed between said base and said first and second uprights, and operatively disposed between said upper support and said first and second uprights, whereby said frame is collapsible into a substantially flat package.

9. An exercise apparatus for performing a striding exercise, comprising:

a frame having a forward end and a rear end;

a first platform suspended from said frame by a first linkage comprising a triangulated four bar linkage;

a second platform suspended from said frame by a second linkage comprising a triangulated four bar linkage;

wherein said first linkage is attached to said frame at a rotating journal positioned left and rearward of the volume centroid of a region occupied by a user standing stationary and erect on said first and second platforms facing said forward end with feet centered on said platforms and at a rotating journal positioned in front of said region, and wherein said second linkage is attached to said frame at a rotating journal positioned right and rearward of said volume centroid and at a rotating journal positioned in front of said region;

a first and second handle pivotally mounted to opposite sides of said frame adjacent and rearward of said volume centroid and operatively attached to said first and second linkage, respectively, to rotate in response to movement of said first and second linkages; and means for resisting motion of said first and second platforms.

10. An exercise apparatus for performing a striding exercise, comprising:

a frame;

a first platform suspended from said frame by a first linkage comprising a four bar linkage;

a second platform suspended from said frame by a second linkage comprising a four bar linkage;

a common pivot shaft simultaneously functioning as a pivot point of said first linkage and a pivot point of said second linkage;

friction resistance means disposed about said common pivot shaft for simultaneously resisting motion of said first and second linkages; and a first and second handle pivotally mounted to opposite sides of said frame adjacent and behind said user and operatively attached to said first and second linkages, respectively, to rotate in response to movement of said first and second linkages.

11. An exercise apparatus for performing a striding exercise, comprising:

a frame having a forward end and a rear end;

a first platform suspended from said frame by a first linkage comprising a triangulated four bar linkage having a forward and a rearward pivot;

a second platform suspended from said frame by a second linkage comprising a triangulated four bar linkage having a forward and a rearward pivot, said first and second platforms capable of supporting a user facing in a forward direction;

a first and second handle pivotally mounted to opposite sides of said frame adjacent and behind the volume centroid of a region occupied by the user standing stationary and erect on said first and second platforms facing said forward end with feet centered on said platforms and operatively attached to said first and second linkages, respectively, to rotate in response to movement of said first and second linkages.

* * * * *